US006421969B1

(12) United States Patent
Vølstad

(10) Patent No.: US 6,421,969 B1
(45) Date of Patent: Jul. 23, 2002

(54) DEVICE FORMING A PARTITION BETWEEN STOREYS

(75) Inventor: Ove C. Vølstad, Kvernaland (NO)

(73) Assignee: Vølstad Energy AS, Kvernaland (NO)

( * ) Notice: Subject to any disclaimer, the term of this patent is extended or adjusted under 35 U.S.C. 154(b) by 0 days.

(21) Appl. No.: 09/701,769

(22) PCT Filed: May 20, 1999

(86) PCT No.: PCT/NO99/00162

§ 371 (c)(1),
(2), (4) Date: Dec. 1, 2000

(87) PCT Pub. No.: WO96/63179

PCT Pub. Date: Dec. 9, 1999

(30) Foreign Application Priority Data

Jun. 2, 1998 (NO) ..... 2520/98

(51) Int. Cl.[7] ..... E04B 5/48; E04B 5/14; F24D 5/10

(52) U.S. Cl. ..... 52/220.4; 52/302.1; 52/302.3; 52/414; 52/450; 52/783.16; 52/783.17; 52/783.11

(58) Field of Search ..... 52/250, 220.4, 52/302.1, 302.3, 414, 450, 630, 783.11, 783.14, 783.15, 783.16, 783.17

(56) References Cited

U.S. PATENT DOCUMENTS

| | | | | | |
|---|---|---|---|---|---|
| 32,266 | A | * | 5/1861 | Seely | 52/783.16 |
| 2,294,890 | A | | 9/1942 | Brinker | |
| 2,318,820 | A | * | 5/1943 | Voigt et al. | 52/302.3 |
| 2,641,449 | A | * | 6/1953 | Antony | 52/220.4 X |
| 3,037,592 | A | * | 6/1962 | Shipley et al. | 52/783.16 X |
| 3,397,497 | A | * | 8/1968 | Shea et al. | 52/450 X |
| 3,488,905 | A | * | 1/1970 | Campbell | 52/302.3 X |
| 3,732,656 | A | * | 5/1973 | Robinsky | 52/783.15 |
| 3,802,147 | A | | 4/1974 | O'Konski | |
| 3,812,636 | A | * | 5/1974 | Albrecht et al. | 52/220.4 X |
| 3,950,910 | A | * | 4/1976 | Pobanz | 52/783.11 |
| 4,133,158 | A | * | 1/1979 | Ting | 52/783.16 X |
| 5,765,329 | A | * | 6/1998 | Huang | 52/302.3 |

FOREIGN PATENT DOCUMENTS

| | | | |
|---|---|---|---|
| FR | 2290544 | * | 6/1976 |
| SE | 502251 | | 9/1995 |
| WO | WO95/00726 | | 1/1995 |
| WO | WO99/01619 | | 1/1999 |

* cited by examiner

*Primary Examiner*—Laura A. Callo
(74) *Attorney, Agent, or Firm*—Andrus, Sceales, Starke & Sawall, LLP

(57) ABSTRACT

The invention relates to a device by a constructional part (1) preferably extending between supporting parts (10, 11, 12) of a building or plant constructions, and preferably forming a partition between storeys, such as a floor or a deck. The constructional part (1) is self-supported, preferably of light-weight material and comprises a channel system for air, so that the constructional part (1) may provide heating and/or cooling of rooms in the building or plant construction, or may thaw snow and ice lying on the constructional part, respectively. The constructional part (1) is made up of at least three interconnected layers (2, 3, 4) of corrugated sheet material. The layers (2, 3, 4) are arranged at angles in relation to each other, in such a way that corrugations form a preferably right angle between themselves, so that the corrugations of the layers (2, 3, 4) form a channel system in the constructional part (1). A number of holes (6) are made in the intermediate layer (3). The holes (6) extend transversely to and preferably in a plane through the mid section of the corrugations, so that air at a temperature suitable for heating and/or cooling, or thawing, respectively, may be supplied and/or extracted in a controlled manner in the channel system formed. The corrugations of the upper layer (4) are advantageously filled with an additional cast (5) of light-weight material of good thermal conductivity to a level at least at the height of the corrugation ridges of the upper sheet layer (4).

6 Claims, 3 Drawing Sheets

DEVICE FORMING A PARTITION BETWEEN STOREYS

CROSS REFERENCE TO RELATED APPLICATION

The present application is the U.S. national stage application of International Application PCT/NO99/00162, filed May 20, 1999, which international application was published on Dec. 9, 1999 as International Publication WO 99/63179 in the English language. The International Application claims the priority of Norwegian Patent Application 19982520, filed Jun. 2, 1998.

BACKGROUND OF THE INVENTION

The invention relates to a device by a constructional part preferably extending between supporting parts of a building or plant construction, and preferably forming a partition between storeys, such as a floor or deck.

In known building and plant constructions the storey-separating constructional part is normally of concrete. The constructional part usually extends between the supporting parts of the building or plant construction, and is either cemented in situ or is in the form of prefabricated elements. Work on such constructional parts of concrete is resource demanding in its own ways. The use of heavy material such as concrete in the partition between storeys, entails that the supporting parts must be increased in size. Besides, each storey must be provided with additional height of at least 30 cm to provide room for channels for the air normally used for heating and/or cooling rooms in the building or plant construction. All these things are cost-increasing conditions of known constructions.

Among persons skilled in the art, there is a certain skepticism towards the use of material other than concrete in e.g. storey-separating constructional parts. Said skepticism involves, among other things, doubt as to carrying capacity, durability, etc. Neither has there been any capability of utilising the partition between storeys for carrying for example air which is used for heating and cooling. The objections in this matter are that the carrying capacity will be weakened, that the constructional part cannot be used for heating and cooling in a suitable manner, etc.

Besides, it is well known that the work of clearing snow and ice results in great costs during construction, as well as during the subsequent operation and maintenance of the building and the plant construction.

SUMMARY OF THE INVENTION

An object of the present invention is to avoid, to the greatest possible degree, the above heavy, work-demanding and cost-increasing constructional parts in concrete. Other objects are to reduce the storey height by the use of freely suspended air channels being avoided. Likewise, it is desired to provide a more efficient means of removing snow and ice lying on the constructional part, for instance when it forms part of the roof of the building or plant, and which means may be used for thawing snow and ice while the building or plant construction is under construction.

This has been realised by means of the present device by a constructional part preferably extending between supporting parts of a building or plant construction, and preferably forming a partition between storeys, such as a floor or a deck. The invention is characterized by the fact that the constructional part is self-supporting, preferably-of light-weight material and comprises a channel system, so that the constructional part may be utilised for heating and/or cooling of rooms in the building or plant construction, or may thaw snow or ice lying on the constructional part, respectively. The constructional part is made up of at least three interconnected layers of corrugated sheet material. The layers are placed at angles in such a way that corrugations form a preferably right angle between themselves, so that the corrugations of the sheet layers form a channel system. The channels are interconnected by a number of holes having been made in the intermediate layer. The holes extend transversely to and preferably in one plane through the mid section of the layer, so that air at a temperature adjusted for heating and/or cooling and thawing, respectively, may be taken through the formed channel system in a controlled manner. Other advantageous features of the invention will appear from the following part of the specification and the dependent claims.

BRIEF DESCRIPTION OF THE SEVERAL VIEWS OF THE DRAWING

Referring to the set of figures, preferable non-limiting embodiments of the invention will be explained in further detail.

DETAILED DESCRIPTION OF THE INVENTION

Figure 1:
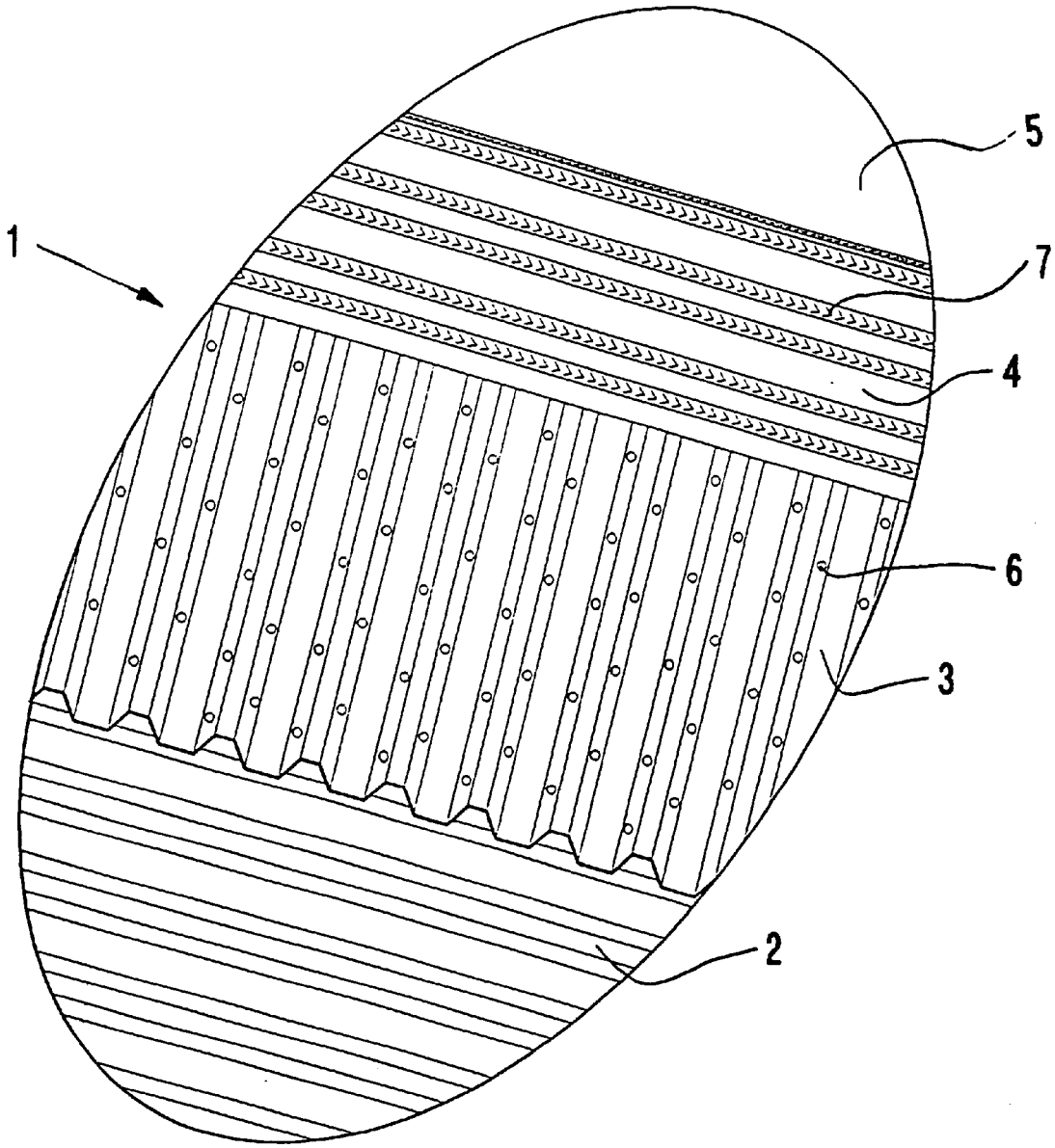
FIG. 1 shows schematically a view of the present construction part, drawn so that the configuration shows.
Figure 2:
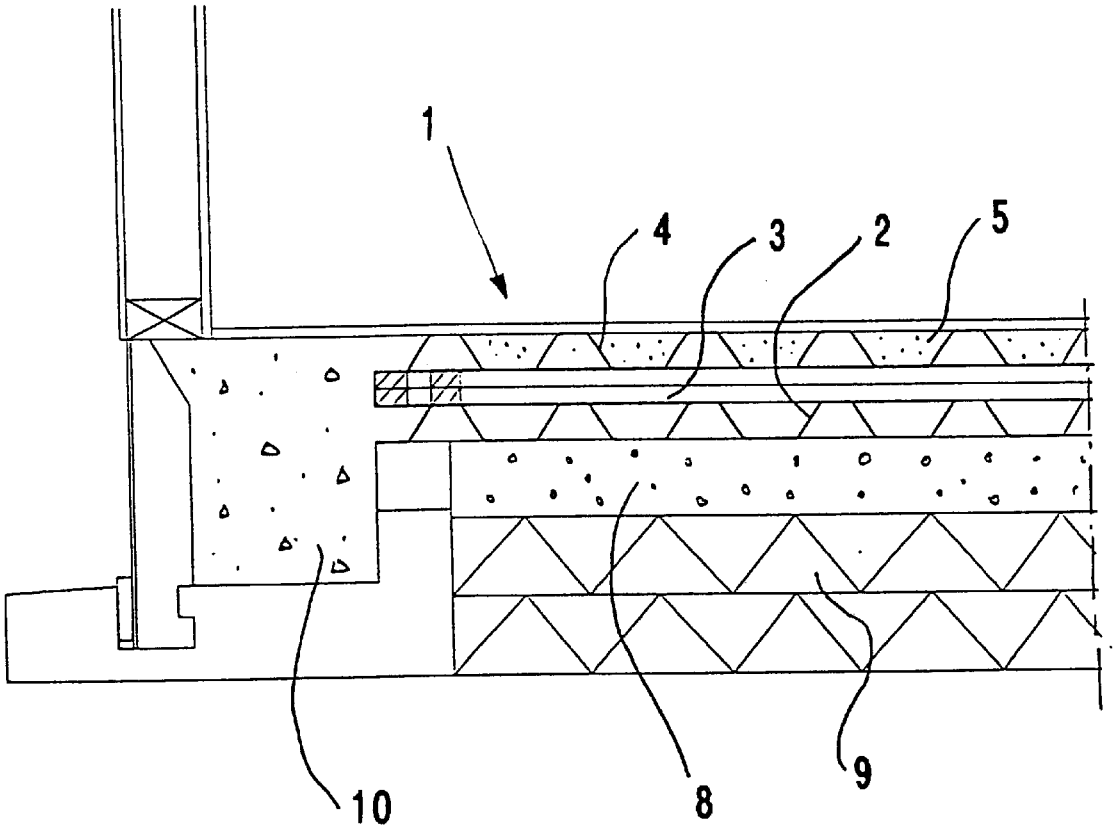
FIG. 2 shows a schematic vertical section of for example a detached house in which the constructional part is used as a floor on the ground in the lowermost storey, and possibly in the roof of the detached house.

According to the invention, the present constructional part 1 should preferably form a storey-separating part such as a floor or deck in a building or plant construction. The building or plant construction may be of different types, e.g. a detached house, a multi-storey building, a road bridge etc. The constructional part 1 which is self-supporting and of light-weight material extends between supporting parts 10, 11, 12 of the building or plant construction. In FIG. 2 it is shown in connection with an annular wall 10, while in FIG. 3 it extends between girders 11, 12. In FIG. 2 is shown that the constructional part may rest on layers of insulating material, e.g. Leca 8 and polystyrene 9. It will also be of advantage to insulate the constructional part 1 on its underside when it is used as a deck between storeys in the building or plant construction.

Moreover, the constructional part 1 comprises a channel system for air to be used for heating or cooling of rooms in the building or plant construction, or for thawing snow or ice lying on the constructional part 1, respectively. Said channel system which enables the constructional part to provide heating and/or cooling, and the self-supporting and light-weight properties of the constructional part 1 are provided by the constructional part 1 being made up of at least three interconnected layers 2, 3, 4 of corrugated sheet material. The layers 2, 3, 4 are placed at angles in such a way that the corrugations form a preferably right angle between themselves. The channels formed thereby, are made to communicate with each other by a number of holes 6 having been made in the sheet walls between ridges and valleys of the intermediate sheet layer 3. The holes 6 extend transversely to and preferably in a plane through the mid section of the layer 3, so that air at the appropriate temperature may be carried through the channel system in a controlled manner.

The layers 2, 3, 4 are connected to each other at contact points between corrugation valleys and ridges by means of popping, gluing, screwing, welding or similar. To ensure good temperature exchange, the corrugations of the upper layer 4 are filled with additional cast 5 of light-weight material of good thermal conductivity to a level at least at the height of the corrugation ridges. The walls of the corrugations in the part to be cast in, may with advantage have embossings 7 either projecting from or into the wall of the corrugation, so that the co-operation between sheet material. and additional cast 5 is the best possible.

Air may be supplied and/or extracted from the constructional part 1 through at least one channel 14 in the supporting parts 10, 11, 12 of the building construction. Each channel 14 is connected in a suitable manner to the cannel system of the constructional part 1. Besides this, it will not be explained in further detail how air at temperatures for heating or cooling, or possibly thawing may be provided, since that is a condition which is outside the scope of the present invention. It shall only be mentioned briefly that used air may be carried through a heat exchanger to take care of energy still left in the used air from the constructional part 1.

Figure 3:
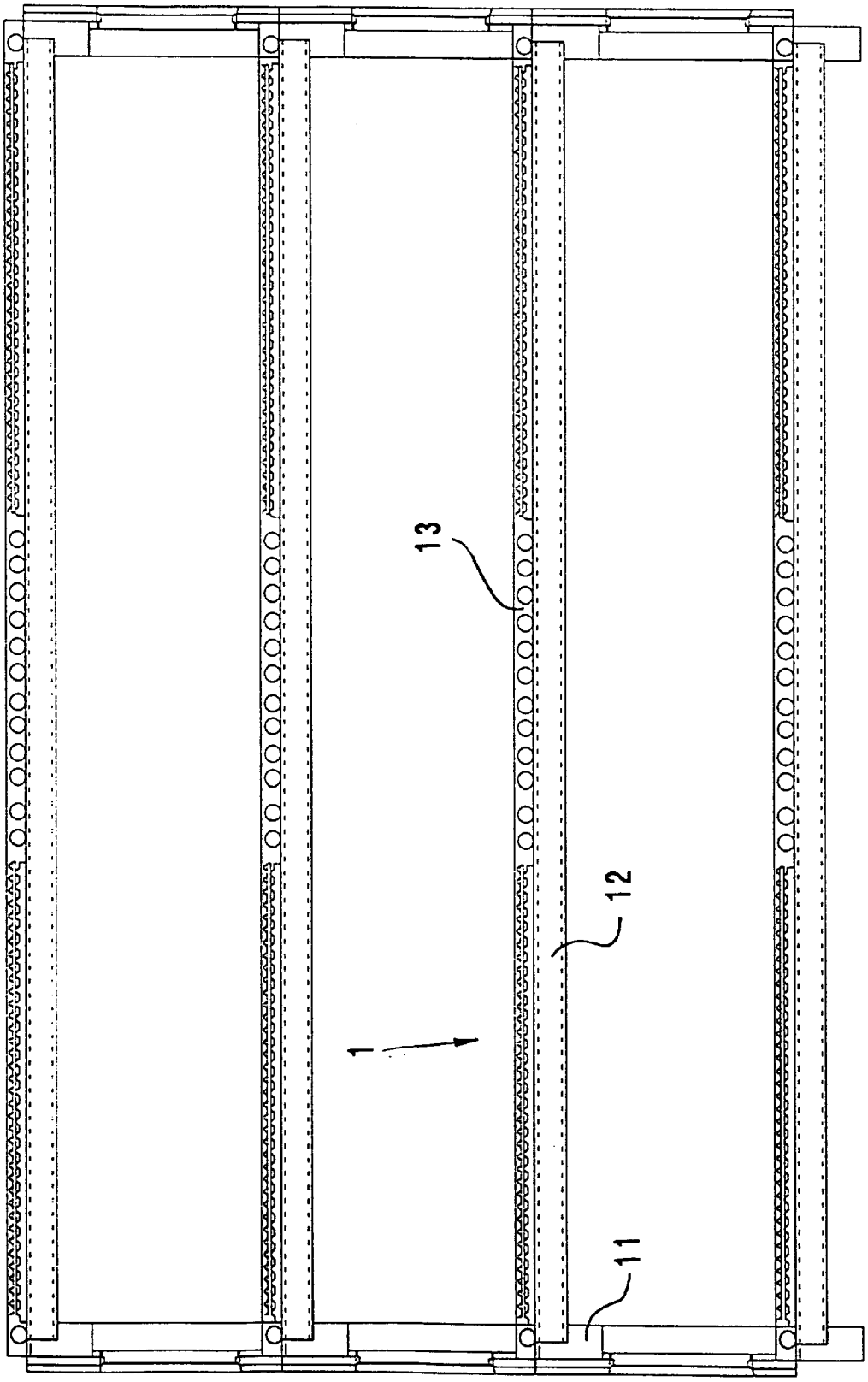
FIG. 3 shows a schematic vertical section through a building of several storeys, in which the constructional part is used as as a partition which forms floor and ceiling of the building.

In certain building constructions the need for heating or cooling will suggest that only parts of the partition between storeys are provided with the present constructional part 1. Part of the partition between the storeys may then, as shown in FIG. 3, be replaced by one or more intermediate parts 13 of a different configuration than the present constructional part 1. It is also given that the constructional part 1 may be composed of segments of smaller parts. These will then have to be connected along the side edges in a suitable manner, so that there is formed a constructional part 1 of dimensions adjusted for the building or plant construction in question.

The roof of the buildings shown in FIGS. 2 and 3 could without difficulty be kept completely and/or periodically free of snow and ice by the use of the present constructional part 1 in the storey partition forming the roofs of said buildings. The constructional part could also be used to keep, for example, the road surface of a bridge construction free of snow and ice.

The heating or cooling, or the thawing of snow and ice, respectively, takes place through utilisation of the temperature difference between the air in the constructional part 1 and the rooms, the snow and the ice, respectively. The surface of the constructional part will then have, for example, either a higher or a lower temperature than that of the room. Besides, dependent on whether heating or cooling is to take place, the constructional part 1 will contribute to the room temperature being changed to the desired level. It should be mentioned in particular that with the present invention the heating and the cooling can take place with a smaller temperature difference between the air supplied and the room, than what is common in traditional air plants, by walking on a floor with either increased or reduced temperature.

What is claimed is:

1. Arrangements in constructural elements (1) intended to be incorporated in a building or plant construction, in which said constructural element (1) will be orientated in a substantially horizontal position, forming a partition between storeys, such as a floor or a deck, said constructural element being shaped and designed with a channel system for flowing air, and comprising at least two parallel layers in the form of interconnected corrugated sheets (2, 3, 4), the corrugations of two layers crossing each other perpendicularly, characterized in that said constructural element (1) additionally comprises at least one further corrugated sheet (3) constituting a third, intermediate layer between two external layers (2, 4), one upper layer (4) and one lower layer (2) as referred to the horizontal position of use, said intermediate corrugated sheet (3) being shaped with a plurality of through-going lateral holes (6) interconnecting air spaces forming air channel systems at either side of said intermediate sheet (3), defined by the internal side faces of the corrugated sheets (2, 4) surrounding said third corrugated sheet (3).

2. Arrangements as set forth in claim 1, characterized in that the lateral holes (6) in the intermediate layer (3) are positioned in the middle portion of the intermediate layer (3).

3. Arrangements as set forth in claim 2, characterized in that the troughs of the corrugations of the upper layer (4) are filled with a castable, hardenable, light-weight material (5) exhibiting good thermal conducting properties, to a level positioned at least corresponding to the level of the wave crests of the corrugations.

4. Arrangements as set forth in claim 1, characterized in that the troughs of the corrugations of the upper layer (4) are filled with a castable, hardenable, light-weight material (5) exhibiting good thermal conducting properties, to a level positioned at least corresponding to the level of the wave crests of the corrugations.

5. Arrangements as set forth in claim 4, characterized in that the corrugation wall of the upper sheet (4) to be filled with said castable material (5) is provided with embossings (7).

6. Use of a multilayer-constructural element shaped and designed in accordance with claim 1 as floor or paving disposed substantially horizontally, covering a free span, wherein the multilayer-constructural element is-shaped, designed and dimensioned so as to be self-supporting, withstanding bending strains, compressive and tensile tensions.

* * * * *